United States Patent [19]

Bernard et al.

[11] Patent Number: 4,471,581

[45] Date of Patent: Sep. 18, 1984

[54] UNIVERSAL TWIST DRILL SHARPENER APPARATUS

[75] Inventors: David A. Bernard; Arthur A. Bernard; Richard A. Bernard, all of Ashland, Oreg.

[73] Assignee: Darex Corporation, Ashland, Oreg.

[21] Appl. No.: 416,280

[22] Filed: Sep. 9, 1982

[51] Int. Cl.[3] ..... B24B 19/00

[52] U.S. Cl. ..... 51/219 PC; 51/124 R; 51/125.5

[58] Field of Search ..... 51/73 R, 225, 124 R, 51/219 R, 219 PC, 5 R, 3, 125.5; 269/130–132; 279/52, 53, 55, 56, 58; 24/68 D

[56] References Cited

U.S. PATENT DOCUMENTS

| | | | |
|---|---|---|---|
| 1,816,648 | 7/1931 | Gray | 279/56 |
| 2,109,308 | 2/1938 | Adams | 51/219 PC |
| 2,445,194 | 7/1948 | Umbdenstock | 51/219 PC |
| 2,746,758 | 5/1956 | Stoner | 279/53 |
| 2,829,900 | 4/1958 | Davis | 279/56 |
| 2,907,149 | 10/1959 | Whitesel | 51/210 |
| 3,060,580 | 10/1962 | Wells | 279/53 |
| 4,001,975 | 1/1977 | Bernard et al. | 51/5 R |
| 4,093,247 | 6/1978 | Bernard et al. | 279/53 |

FOREIGN PATENT DOCUMENTS 36068 12/1911 Sweden .

OTHER PUBLICATIONS

Vearl A. Williams, "It's Time to Evaluate the 'Care and Feeding' of Your Twist Drills", *Production,* 4–1982, pp. 60–65.

*Primary Examiner*—Frederick R. Schmidt
*Assistant Examiner*—Matthew D. Daschel
*Attorney, Agent, or Firm*—Kerkam, Stowell, Kondracki & Clarke

[57] ABSTRACT

A relatively low cost twist drill sharpener apparatus employable with a rotary grinding wheel has a twist drill alignment fixture which positions the drill with respect to the drill holding chuck. The twist drill holding chuck has mounted thereto one or a pair of cam elements which cooperate with a sharpener fixture which is adjustable for height, pivotal motion and backward and forward motion relative to the rotary grinding wheel. The fixture has mounted thereto a second cam and is adapted to receive the twist drill chuck and control the grinding of the twist drill when the chuck is pressed toward the face of the grinding wheel and rotated clockwise. The fixture and the chuck are also adapted to receive a wheel dressing element.

15 Claims, 31 Drawing Figures

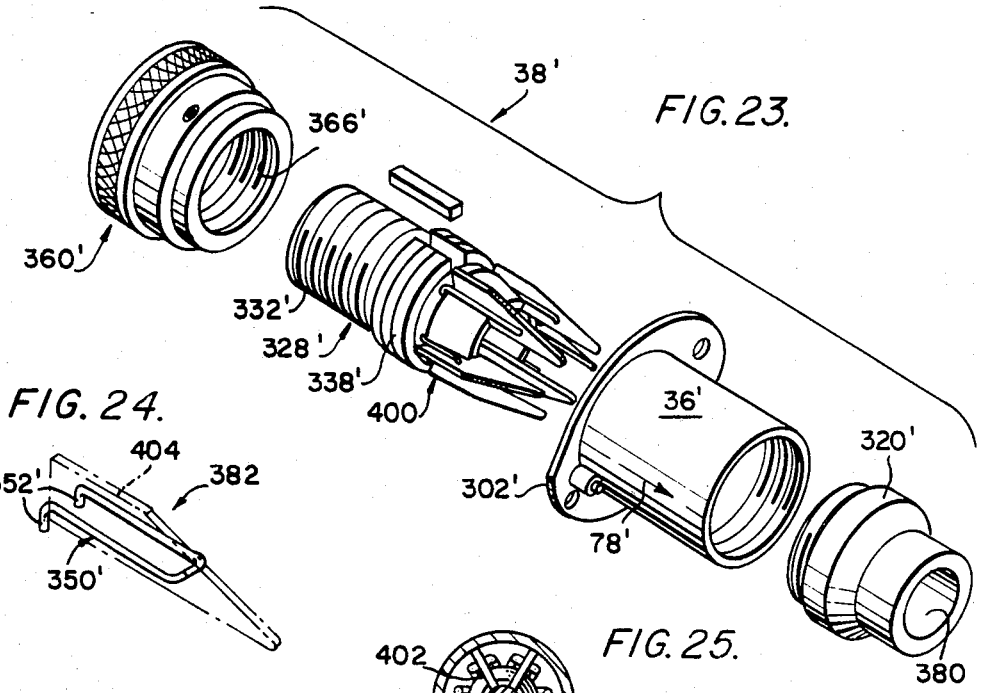
FIG. 23.
FIG. 24.
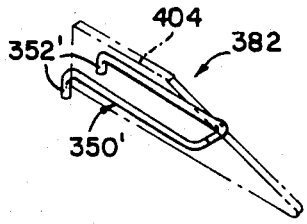
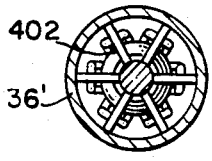
FIG. 25.
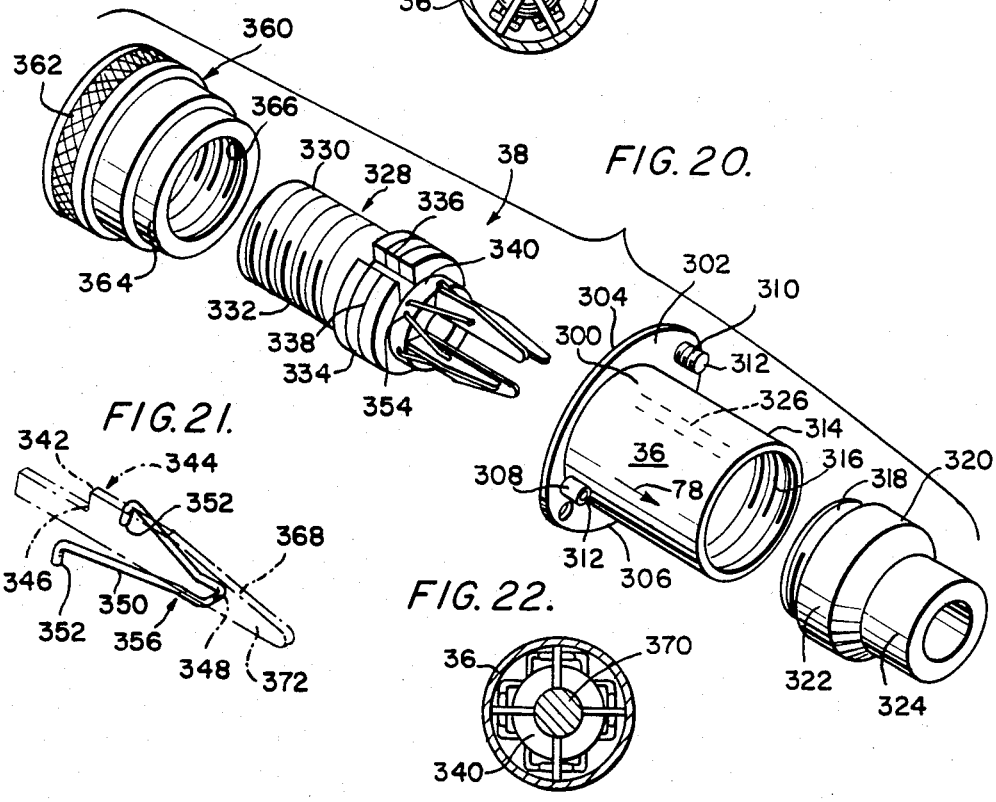
FIG. 20.
FIG. 21.
FIG. 22.

UNIVERSAL TWIST DRILL SHARPENER APPARATUS

REFERENCE TO RELATED SUBJECT MATTER

Related subject matter is disclosed and claimed in U.S. Pat. No. 4,001,975 Bernard et al; U.S. Pat. No. 4,093,247 Bernard et al. and in U.S. patent application Ser. No. 416,281 filed Sept. 9, 1982 ande titled "Twist Drill Point Splitting/Web Thinning Apparatus", Bernard et al.

TECHNICAL FIELD

This invention relates to a precision, relatively inexpensive twist drill sharpening apparatus which is used in conjunction with any standard bench or pedestal rotary grinder.

BACKGROUND OF THE INVENTION

Common twist drills are a very standardized tool and when purchased new the geometry at the cutting end of twist drills is a standardized geometry generally selected by the Metal Cutting Tool Institute as the best geometry for all general purpose drilling and is an included point of 118°, a lip relief angle of 6° to 18° (depending on drill diameter), a chisel edge angle of 120°–130°, and the center of the chisel edge accurate to within 0.003 inch with the axis of the drill. Drills with this standardized point geometry are purchasable at hardward stores and industrial supply distributors by homeowners, hobbyist, auto mechanics, building tradesmen, millwrights and machinists.

If the drill point angle and/or the cutting lip relief angle needs to be different than standardized geometry to more efficiently drill a softer material such as wood or plastic which is generally drilled with a 90° point or a hard metal such as manganese bronze which is generally drilled with a 135° point, then the geometry must be changed by regrinding before the new drill is used.

A discussion of various drills is found in the April 1982 issue of "Production", pages 60 through 65. This article points out that about 250 million twist drills are used annually in the U.S. industry of which about 98 per cent are ½" diameter or under.

Good quality high-speed steel twist drills are expensive, yet, only a very small percentage of the twist drills purchased are ever re-sharpened because it is very difficult for even a master machinist to resharpen the cutting lips by hand and produce the most efficient geometry. Generally, drills resharpened by hand remove material inefficiently, quickly become overheated, lose their sharpness and are scraped.

For these reasons thousand of small manufacturers scrap a number of twist drills per day and such loss can amount to a hundred and more dollars per week per manufacturer.

The size of possibly not less than 98 percent of all twist drills manufactured and used are within the range of 1/16 inch to ½ inch diameter and within this range there are 29 fractional inch sizes, 26 letter sizes, 56 numeral sizes, and 140 millimeter sizes, and one of the main objects of this invention is to provide a drill sharpener whereby all of these different sizes of drills, about 250 in all, can be handled by one relatively inexpensive drill holding chuck, instead of having to use 250 different sizes of collets for handling each of the 250 different sizes of drills as is the general practice with most prior art drill sharpeners.

U.S. Pat. Nos. 4,001,975 and 4,093,247 disclose and claim a twist-drill sharpener, aligning fixture and novel chuck which accomplishes these objectives and provides a commercially sucessful product except that the cost of manufacturing the twist drill fixture, aligning fixture and twist drill holding chuck has been found to be too high for many smaller shops and individuals that do not have enough drills to sharpen to justify the cost expenditures.

It is therefore one of the primary objects of the present invention to provide a precision twist drill sharpener apparatus including an aligning fixture, and facing device, which are not necessarily an integral part of the rotary grinder (which comprises a major cost item of the unitary twist drill sharpener of the prior said U.S. Patents).

SUMMARY OF THE INVENTION

The drill sharpener of the invention produces the required configuration of movements at the cutting end of twist drills during the sharpening operation to quickly, accurately, and simultaneously grind and sharpen the cutting lips of two, three, four, etc. flute twist drills to any preferred drill point angle, to any preferred lip relief angle, to any preferred chisel angle, and very accurately locate the center of the chisel point with the center of the drill, by simply manually rotating a chuck containing the drill in a fixture as the cutting end of the drill is manually pressed against the face of a rotating grinding wheel.

In regards to the standardized geometry, it is pointed out that the relief angle of the two cutting lips increases from the periphery to the center of the drill. For example, a relief angle referred to as 12° is the relief at the peripheral end of the cutting lips and this 12° gradually increases to where the relief angle at the chisel point can be double that at the periphery, and more depending on the diameter of the drill.

In general, the invention includes a small light-weight adjustable base which is adapted to be mounted adjacent a 6 or 7 inches diameter grinding wheel with, for example, a ¾ inch width face.

The apparatus includes a separately handled drill chuck having low cost sheet metal stampings which perform as jaws, and dual function jaw springs. The jaw springs force the jaws open and keep them against the inside wall of the chuck body and they also hold the jaws so they remain parallel to each other in the chuck body. The drill chuck mounts one cam which cam, in conjunction with a fixture mounted cam and a pair of cam followers control the twist drill cutting.

The apparatus includes a fixture, separate from the sharpening fixture which has two purposes, namely, (1) to establish an exact dimension between the tip of the drill and one of the two cams before the drill is gripped by the jaws of the chuck, and (2) to very accurately align the two cutting lips of the drill with one of the cams.

In addition the apparatus includes a second fixture or sharpening fixture which is mounted to the base which second fixture is used for producing the required geometry at the cutting end of the drill during the sharpening operations. The second fixture has two bearings into which the drill chuck is inserted after the two lips of the drill are aligned with an index arrow in the first fixture. The fixture is hinge mounted on the base portion, and by merely applying a light push force on the chuck as the chuck is manually rotated clockwise in the fixture one cam follower follows the face of one of the cams which feeds the end of the drill toward the face of the grinding wheel while simultaneously a second cam follower following the face of the second cam swings the end of the drill away from the face of the grinding wheel, and, as will be more fully described hereinafter, it is by feeding the end of the drill toward the face of the grinding wheel with one cam while simultaneously using a second cam to swing the end of the drill away from the face of the wheel which produces the relief angle.

The mounting between the second fixture and the base, and the base and support means therefore permits precise feed control so that only the amount of material the operator wants to remove from the twist drill is removed during the sharpening operation. Another motion between the chuck fixture and the base permits the chuck to pivot to any preferred angle from 90° to 180°.

As herein before set forth some drills have split points and/or thin webs adjacent the cutting point. In order to accomplish point splitting and web thinning the drill sharpening apparatus may include a fixture separate from the normal drill sharpening fixture. The point splitting/web thinning fixture is described and claimed in said copending application hereinbefore referenced.

BRIEF DESCRIPTION OF THE DRAWINGS

The invention will be described in greater detail in reference to the accompanying drawings wherein:

FIG. 20 is an exploded view of one chuck constructed in accordance of the teachings of the present invention;

FIG. 21 is a perspective view of one jaw and its co-operating spring means of the chuck illustrated in FIG. 20;

FIG. 22 is a cross-sectional view through the chuck illustrated in FIG. 20 showing the alignment of the various jaws of the chuck;

FIG. 23 is a view like 20 illustrating another form of twist drill holding chuck of the present invention;

FIG. 24 is a view like FIG. 21 of one of the chuck jaws and holding springs;

FIG. 25 is a view like FIG. 22 through the twist drill holding chuck shown in FIG. 23.

DESCRIPTION OF THE PREFERRED EMBODIMENTS

Figure 1:
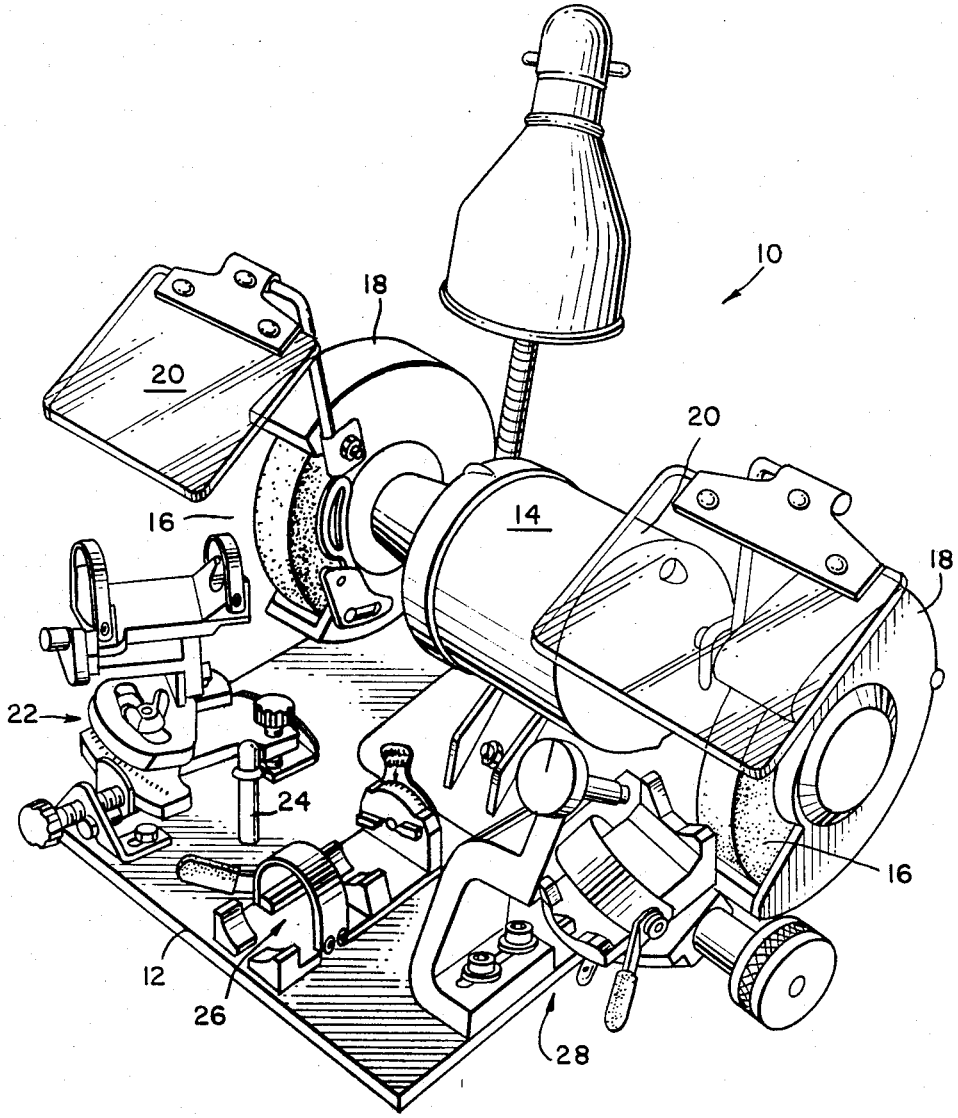
FIG. 1 is a perspective view of various elements of the improved drill sharpening apparatus of this invention shown in conjunction with a conventional double-ended grinder and a fixture for twist drill point splitting-/web thinning described in detail in our co-pending application.
Figure 2:
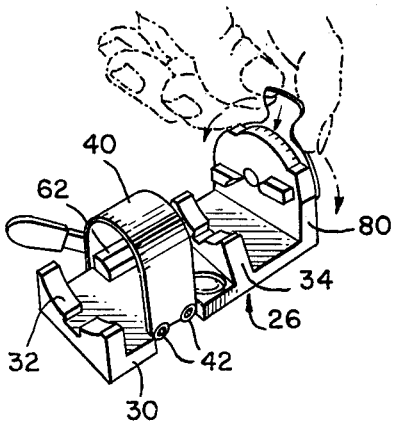
FIG. 2 is a perspective view of a relief setting fixture employed in conjunction with the drill chuck for establishing the proper relationship between the twist drill and its attached cam.
Figure 3:
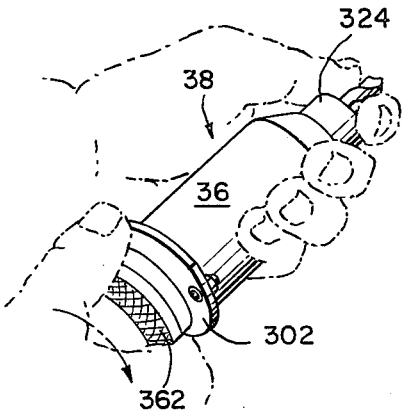
FIG. 3 is a perspective view of one of the novel chucks of the present invention with the drill bit loosely inserted therein.

Referring to FIG. 1 of the drawings, 10 generally designates a drill sharpening device comprising a platform 12 to which is mounted an electric motor 14 having double ended output shafts which carry grinding wheels 16 and conventional guards and eye shields 18 and 20.

The platform 12 mounts a drill sharpening apparatus generally designated 22; a diamond wheel dressing tool 24 and a reilief setting fixture generally designated 26. Also illustrated in FIG. 1 is a point splitting/web thinning fixture generally designated 28 which fixture forms the subject matter of our copending Patent Application entitled "Twist Drill Point Splitting/Web Thinning Apparatus".

Relief Setting Fixture

Figure 10:
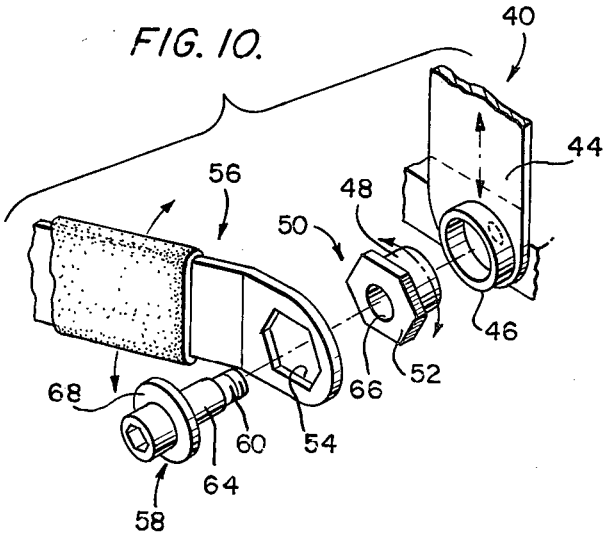
FIG. 10 is an enlarged fragmentary exploded view of the means for tightly engaging the barrel portion of the chuck in the drill bit aligning fixture.

Referring particularly to FIGS. 2 through 11, the relief setting fixture 26 comprises a baseplate 30 having a pair of spaced upstanding cradle members 32 and 34, which cradle members are adapted to support the barrel portion 36 of a special drill holding chuck generally designated 38 which drill holding chuck will be described in greater detail hereinafter. Mounted between the pair of cradles 32 and 34 is plastic or metal bridge 40 mounted on one side of the base 30 by screws 42. The other side of the bridge 40 designated 44 FIG. 10, is provided with a rigid sleeve 46 which rigid sleeve rotatably receives the barrel portion 48 of an eccentric generally designated 50 having a hex end 52. The hex end 52 is received in a corresponding opening 54 in a handle element generally designated 56. The barrel 46, the eccentric 50 and the operating arm or lever 56 are maintained in assembled relationship on a shaft generally designated 58 which shaft is threaded as at 60 and received in a corresponding threaded bore in a block element 62 integral with the base 30 of the fixture. A shank portion 64 is rotatably received in bore 66 of the eccentric 50 and a shoulder 68 maintains the assembly in operable relation.

Figure 4:
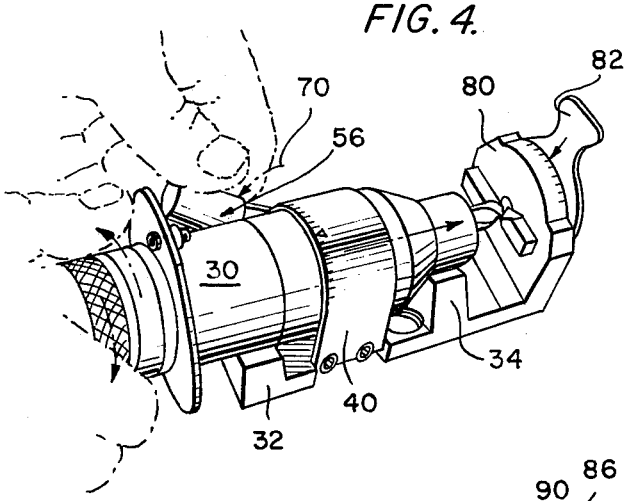
FIG. 4 illustrates a step in properly positioning the drill in the drill chuck.
Figure 5:
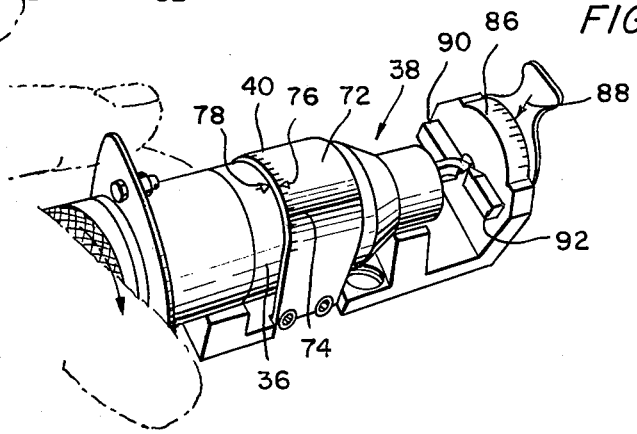
FIG. 5 illustrates another step in aligning the twist drill with the chuck in the fixture illustrated in FIG. 2.

It will be seen that rotating the handle or lever 56 in one direction enlarges the bridge or band 40 and rotation in the opposite direction shortens the bridge or band 40 relative to the top surfaces of cradles 32 and 34, whereby when the chuck 38 is positioned in the fixture as shown, for example, in FIG. 4, movement of the lever 56 in the direction of the directional arrow 70 causes the band to tightly engage a substantial portion of the barrel surface 36, rigidly holding the chuck in a fixed position in the fixture.

The band 40 has indicia on its top surface 72 as indicated at 74 which indicia includes an arrowhead 76. The arrowhead 76 indicates the proper location of a corresponding arrowhead 78 on the barrel portion 36 of the chuck 38 for a 12° relief angle. Moving the chuck carried arrowhead 78 to the left (FIG. 5) increases the relief angle and moving it to the right of the arrow 76 reduces the relief angle.

At the end of the base 30 of the fixture 26 from the saddle 32 is an upstanding wall 80 which will rotatably supports a drill-size lever arm 82. The lever arm 82 is pivotally mounted to the back of the wall 80 on pivot pin 84. The top surface 86 of the wall 80 has imprinted thereon indicia indicating drill size such as 1/16, $\frac{1}{8}$, $\frac{1}{4}$ etc. to $\frac{3}{4}$. The front face of the lever arm 82 is provided with an indicator arrow 88 so that when the indicating arrow is aligned with the indicia 86 indicating $\frac{1}{4}$ the movable pawls 90 and 92 are positioned such that the tips 94 of FIG. 8 Will grasp the flutes on a $\frac{1}{4}$ inch drill and properly position the flutes for the actual sharpening procedure. Further, when the chuck 36 holding the drill is fully inserted in the fixture 26, the distance between the drill point and any fixed point on the chuck is properly dimensioned.

Figure 6:
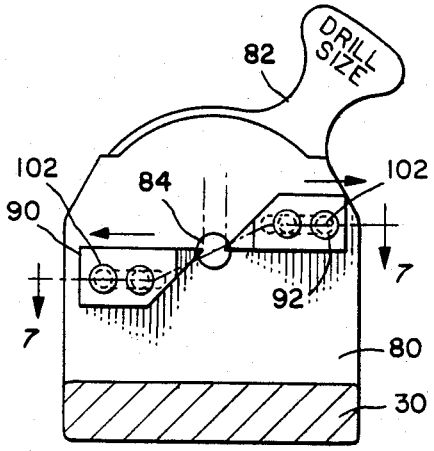
FIG. 6 is an enlarged partial fragmentary view of the twist drill flute engaging pawls of the fixture illustrated in FIG. 2.
Figure 8:
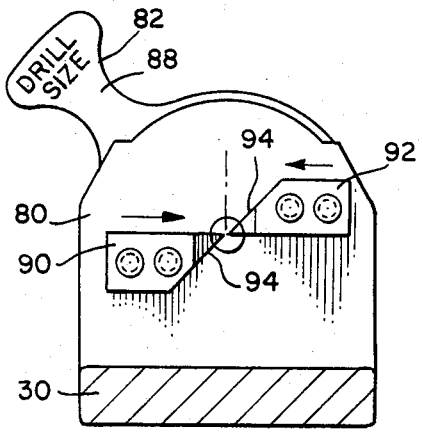
FIG. 8 is a view like FIG. 6 showing the flute engaging elements in another position.
Figure 7:
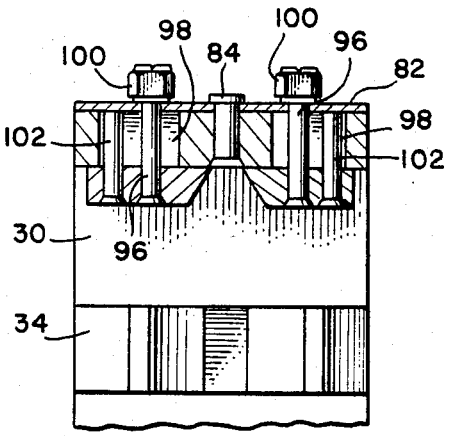
FIG. 7 is a sectional view on line 7—7 of FIG. 6.
Figure 9:
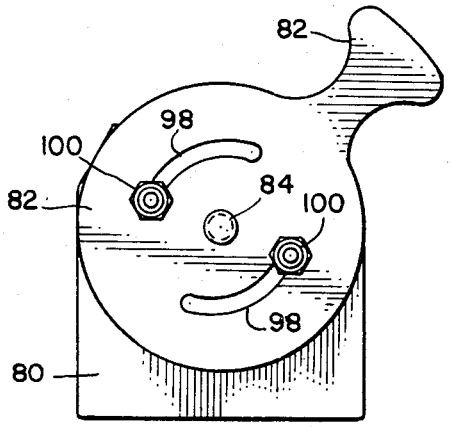
FIG. 9 is the far end view of the structure shown in FIGS. 6–8.

The cutting lip engaging pawls 90 and 92 are moved in the direction of the directional arrows, FIGS. 6 and 8, in a transverse sliding movement. The pawls are connected to studs 96 which pass through slots 98 in the upstanding web 80 which slots are illustrated in FIG. 7. The extended ends of the studs 96 pass through arcuate slots 98 in the lever 82 and are maintained in that position by self-locking nuts 100. In order to prevent rotation of the pawls 90 and 92 each of the pawls carries a pin 102 which pins have diameters to be snugly received in the slots 98 in the web 80. The two pins 96 and 102 in each pawl translate the rotational movement of the lever 82 and the arcuate slots 98 into transverse linear movement.

The Drill Sharpening Apparatus

Referring now to FIGS. 12 through 19 the drill sharpening apparatus 22 is composed of the following main components: chuck cradle 200; chuck cradle mount 202; drill point angle adjust element 204; chuck feed plate 206; rear mounting bracket 208 and front mounting bracket 210.

The chuck cradle 200 comprises a casting having four upstanding cradle portions 212 *a, b, c* and *d* with wing portions a and b mounted at the forward end of the cradle and d and c at the rearward end. Bridging the forward upstanding cradle elements 212 *a* and *b* is a nylon or or metal or the like strap 214 and a similar strap is mounted between elements 212 *c* and *d* at the rearward end of the cradle and designated 216. Each of the two bridging straps 214 and 216 are screws connected to the cradle and the openings of the straps are such that any wear on the two bearings surfaces which support the front and body portion of the chuck, as will be more fully described hereinafter, can be taken up by readjusting the pair of straps.

The cradle 200 has pinned thereto a male cone bearing 219 and a shaft 218. This shaft 218 passes through a hole 220 at the top of which is a female cone bearing 217 and at the bottom of which is an opposing female cone bearing 221 all of these forming an integral part of the chuck mounting means 202. A tapered nut 222 is mounted onto the threaded shaft 218 and is tightened until it is snug with female cone 221 and the male bearing 219 is snug with female cone 217. Bearing nut 222 is secured in position by jam screw 223. This type of bearing has an important advantage over a sleeve bearing because it is adjustable as it wears.

A coiled spring 224 is connected to the chuck cradle 200 and to the chuck cradle mounting means. Thus, the chuck cradle 200 can only swing from the stop member 226 about the pivot 218 as shown by the directional arrows 228.

Figure 16:
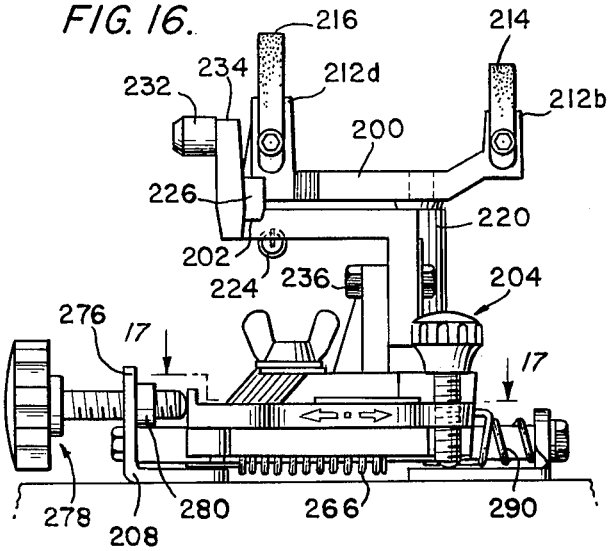
FIG. 16 is a vertical view of the structures shown in FIG. 15.
Figure 18:
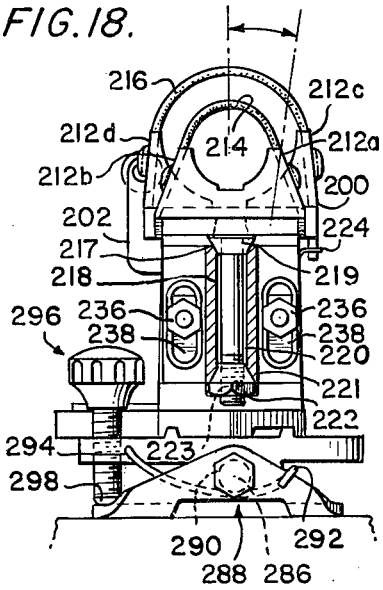
FIG. 18 is a front end view of the structures shown in FIGS. 15 and 16.
Figure 19A:
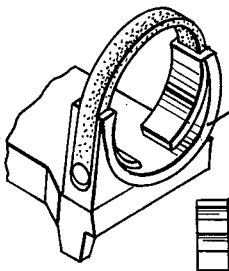
FIG. 19*a* is an illustration of the face cam on the rear face of the chuck cradle.
Figure 19:
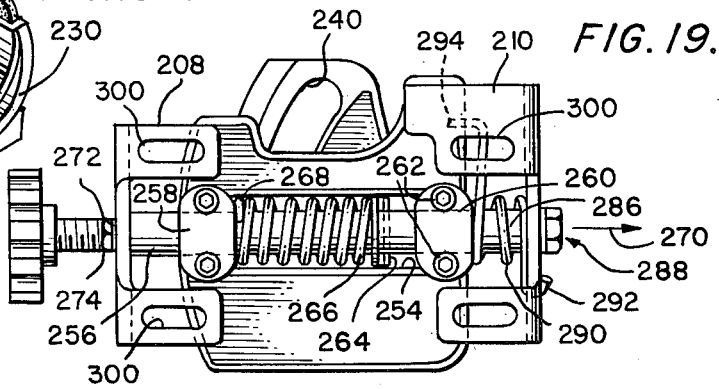
FIG. 19 is a bottom plan view of the drill sharpening fixture.

The rear face of the chuck cradle is formed with a facing cam 230 shown in FIG. 19*a* and the chuck cradle mount 200 has fixed thereto a cam follower 232 which is threaded into upstanding arm 234 as more clearly shown in FIG. 16. The cam follower 232 functions in conjunction with a wing cam affixed to the novel drill holding chucks as to be described hereinafter. The chuck cradle mount 202 is bolted to the drill point angle adjust element 204 by a pair of bolts 236. It will be particularly noted from FIG. 18 that the bolts pass through slotted bolt ways 238 in the chuck cradle mount 200 so that the chuck cradle and its mount may be raised and lowered relative to the base 12, FIG. 1 to permit adjustment of the sharpening tool relative to the peripheral face of the grinding wheel 16, FIG. 1, of the drawing.

The drill point angle adjusting element 204 is provided at its rearward end with an arcuate slot 240 and a point angle indicating arrow 242. At its forward end the casting, forming the adjustment element 204, has an arcuate recess 244, FIG. 15 of the drawing. The arcuate recess or slot 244 mates with an arcuate boss 246 on the chuck on the chuck feed plate 206. A threaded pin 248 projects upwardly from the surface of the chuck feed plate 206 and is received in the arcuate slot 240. A wing nut 250 tightens the drill point angle adjustment 204 to the chuck feed plate 206 at the desired point angle. The chuck feed plate 206 is provided in its bottom surface with a longitudinal recess 254 which receives a cylindrical rod 256. The rod 256 is maintained within the recess 254 by a pair of spring plates 258 at the rear and 260 at the front end. The spring plates are attached to the front and rearward ends of the recess or groove 254 by threaded fasteners generally designated 262. With the spring type fasteners the chuck feed plate 206 has limited sliding motion on the shaft 256 and, further, the plate can rotate on the shaft. A crosspin 264 engages one end of compression spring 266, while the other end of the spring 268 bears against a webbing integral with the recess 254 whereby the shaft 256 is continously urged in the direction of the directional arrow 270, FIG. 19 of the drawing. The rearward end of the shaft 256 is shouldered and threaded and receives thereon the rear mounting bracket 208 which rear mounting bracket is retained on the shaft by a nut and washer arrangement 274. The rear mounting bracket 208 has an upstanding wing portion 276 which is bored to receive a cross feed knob and screw 278. In order to prolong life for the feed screw mechanism, the wing portion 276 has welded thereto a boss 280 which is internally threaded to mate with the threads of the cross feed knob screws. The chuck feed plate 206 is recessed as at 282, FIG. 15 to receive a hard metal or nylon plate 284 which forms a striker plate for the extended end of the cross feed knob screw.

The forward extended end of the shaft 256 designated 286 is shouldered and threaded to receive the forward mounting brackets 210. The mounting bracket 210 is maintained on the shaft end 286 by a nut and washer assembly 288. A helical torque spring 290 has one end 292 which hooks over a forward lip of the front mounting bracket 210 and the opposite end of the spring is received in a bore 294 in the forward end of the chuck feed plate 206.

The front end of the chuck feed plate 206 is bored as at 294 to receive a threaded combination knob and adjusting screw 296. The lower end of the adjusting screw 296 bears on the upper surface of one wing portion of the front mounting bracket as at 298, FIGS. 16 and 18 of the drawing. The adjusting knob varies the angle of tilt of the plate 206 relative to the horizontal and acts against the tension in the spring 290. It will also be noted particularly from FIG. 19 that the front and rear mounting plates 208 and 210 are provided with elongated slots which receive mounting screws for the completed assembly. The slots are commonly designated 300 and in FIG. 1 the assembly is shown attached to the plate 12.

The Twist Drill Holding Chucks

The sharpening device shown and described in this application is provided with two twist drill holding chucks, one generally designated 38 and illustrated in, for example, FIGS. 3 and 20 through 22 having a capacity from 1/16 to ½ inch, and another designated 38' illustrated in FIGS. 23 through 25 having a capacity of ½ inch through ¾ inch.

Referring now to FIGS. 3 and 20 through 22, the chuck 38 comprises a barrel portion 36 which has rigidly attached to its rear end 300 a wing cam 302 having upper and lower cam edge surfaces 304 and 306. The wing cam also carries a pair of cam pins 308 and 310, the faces 312 of each are adapted to contact the face cam 230 formed on the rearward face of the chuck cradle 200. The cam surfaces 304 and 306 are adapted to function in conjunction with the cam roller or pin 232 carried by the rear upstanding plate 234 of the chuck cradle mounting member 202. The front end of the barrel portion 314 is internally threaded as is 316 to receive external threads 318 on a front cone portion 320 of the chuck. The cone portion has a tapered inner bore from one end to the other which tapered bore is designated 322. Externally, the front cone portion 320 is provided with a cylindrical surface 324 which cylindrical surface is received in the front bearing structure of the point setting fixture generally designated 26.

Internally, of the barrel portion 36 of the chuck, is a fixed key shown in broken line and designated 326 in FIG. 20. The chuck 38 also includes a jaw set assembly generally designated 328 which jaw set assembly includes a hollow fixture 330 having a rearwardly threaded portion 332 and a jaw keeper portion 334. The keeper portion has a keyway 336 which rides on the internal key 326; mounted internally on the portion 334 also is a groove to retain a felt wiper 338. The front portion of the fixture 330 designated 340 is slotted to receive the rearward ends 342 of four equally radially spaced chuck jaws 344. It will be noted from FIG. 21 that the rearward ends 342 of each of the chuck jaws 340 are stepped as at 346. Each of the chuck jaws 344 is preferrably formed by stamping from sheet metal to reduce the cost of production of the chuck.

Adjacent the forward end of each jaw, there is a bore 348 which receives a spring member 350. The rearward ends 352 of each spring are interned and received in bores 354 in a front step of the fixture 330. It will be noted that the springs 350 are shaped such that they have a close fitting engagement with the side walls of each jaw 340 at their forward ends generally designated 356 and then flare outwardly for the remainder of their lengths. With this arrangement, the springs urge the jaws in an open position and at the same time, close fitting portions 356 stabilize the jaws against substantial lateral motion.

The chuck assembly is completed by a tightening knob designatd 360 FIG. 20 of the drawings. The tightening knob consists of two parts: an outer knob portion 362 and an internal portion 364. The internal portion is internally threaded as at 366 with threads which mate with threads 332 on the fixture 330. When the chuck is assembled, rotation of the knob 362 causes the fixture 330 to move longitudinally within the barrel 36 and the nose portion 320 so that the sloping edges 368 of each jaw 344 engages the co-operating sloping surface 322 of the nose portion 320 of the chuck to cause the jaws to move inwardly or outwardly for engagement with the outer surface of the twist drill, a portion of which is illustrated at 370 FIG. 22 of the drawing. In order to securely grip twist drills from 1/6 to ½ inch, the length of each jaw 344 is substantial and in a preferred embodiment each flat drill engaging surface 372 is approximately 3 inches.

The second chuck 38' is functionally equivalent to the chuck 38, with certain exceptions to permit insertion in the chuck of drills having diameters ranging from ½ inch to ¾ inch. Referring now to FIGS. 23 through 25 the chuck 38' has a barrel portion 36' of the same diameter as barrel portion 36 so that the barrel portion will properly cradle in the flute aligning fixture and the sharpening fixture. Barrel portion 36' also supports a wing cam 302' identical to wing cam 302. The barrel receives at its forward end a nose portion 320' which is equivalent to nose portion 320 but for the larger bore for receiving bits 380.

The chuck 38' also includes a hollow jaw carrying fixture designated 328'. This fixture is similar to fixture 328 of the chuck 38. The rearward end of the fixture is threaded as at 332' and mates with threads 366' carried by the rear-adjusting piece designated 360'. The middle portion of the forward end of the fixture 328' is grooved to receive a felt washer 338'. At the forward end of the fixture 328', generally designated 400, is a truncated cone configuration which cone is slotted as at 402 to receive the rearward ends 404 of the six chuck jaws 382, FIGS. 24 and 25 of the drawing. The jaws 382 are bored to receive springs 355 having interned rearward ends 352'. The springs help to retain the jaws in proper position in the fixture 328 and at the same time urge each of the jaws into the open position upon opening of the chuck. In the case of chuck 38', the springs do not provide any substantial lateral support for the jaws; however, the more extended nature of the slots in the cone portion 400 provide the necessary control.

Prior to describing the operation of the structures of the present invention, reference should be had to FIGS. 26 through 30 illustrating various forms of common twist drills with each of the twist drills being designated 450*a* through *e*. Each of the twist drills consist of a pair of flutes 452 with each of the cutting points and lips of the five drills being different.

Figure 26:
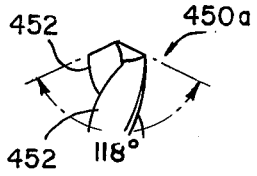
FIGS. 26, 27, 28, 29 and 30 are axial end views of twist drills illustrating some of the common grinding/-sharpening techniques.
Figure 27:
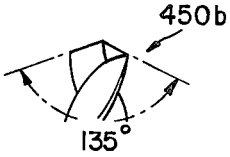
Figure 28:
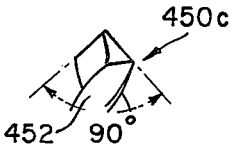

The twist drill illustrated in FIG. 26 has 135° point angle and is frequently preferred for hard and tough materials such as high alloy steels. The drill illustrated in FIG. 28 has a 90° point angle and is preferred for drilling soft and low strength materials, such as some cast irons, aluminum, plastic and wood.

Figure 29:
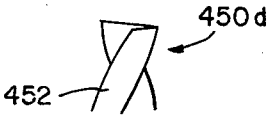

Referring to FIG. 29, the twist drill 450*d* is known as the flat-bottom point and is often used for blind holes or as a counter-bore for Allen head screws.

Figure 30:
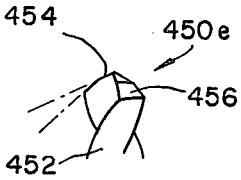

The drill 450*e* shown in FIG. 30 is referred to as the Chamford point drill. Such drills reduce burr generation in many materials and are also very effective in reducing wear at the corner of the lip in abrasive materials such as cast iron or fiberglass. It will be noted that the drill is sharpened first in zone 454 to a standard 118° point configuration and then sharpened in zone 456 at a point angle of 90°.

Operation

Operation of the drill sharpening apparatus will be described in a procedure for sharpening a ¼ inch twist drill having two flutes and to be sharpened with a point angle of 118° and a lip relief of 12°.

The first step is to set the drill size, that is, ¼ inch on the relief setting fixture 26 by movement of the handle 82. The drill to be sharpened is then inserted loosely in the chuck 38 so that the drill protrudes approximately one inch from the end 324 of the chuck. The chuck gripping band 40 is then loosened using lever 56 and the chuck containing the loosely fitting drill is inserted in the relief setting fixture as far as it will go, FIG. 11 of the drawing. The point of the drill should then butt against the face 80 of the relief setting fixture, and the drill will push into the chuck to the proper length. The chuck containing the drill is then slowly rotated clockwise until the alignment arrow 37 is aligned with the 118° marking 76, FIG. 5 of the drawing. This properly aligns the drill cutting lips in reference to the face cam 302 secured to the drill chuck. The chuck is then secured by depressing the grip lever 56, then the drill grip knob 362 on the chuck is rotated clockwise to secure the drill in the chuck.

Figure 12:
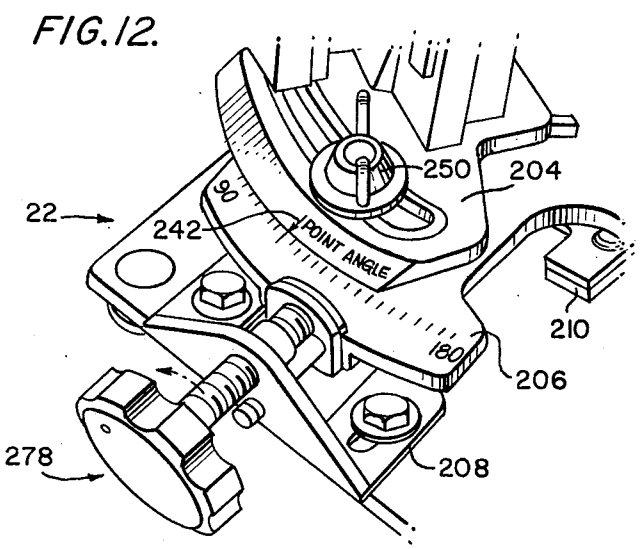
FIG. 12 is an enlarged perspective fragmentary view of the drill sharpening apparatus.
Figure 14:
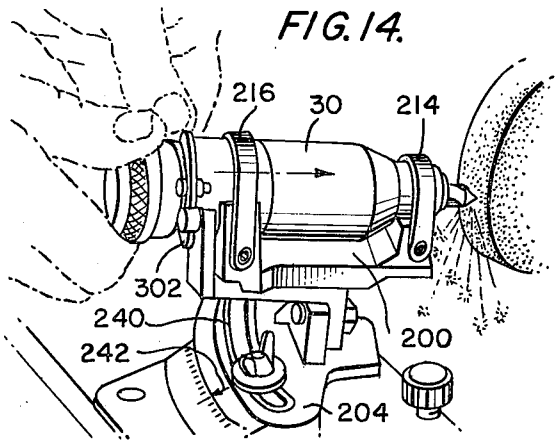
FIG. 14 is a view like FIG. 13 illustrating another view of the drill sharpening fixture with the chuck in operative relationship to a grinding wheel.
Figure 11:
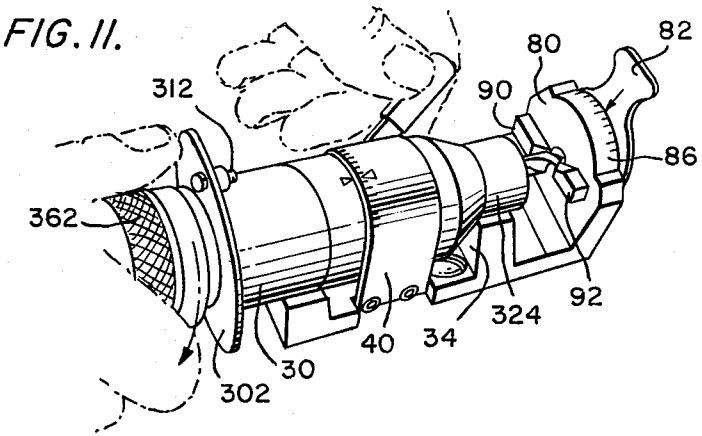
FIG. 11 is another view like FIGS. 4 and 5 illustrating a further step in properly positioning the twist drill in the twist drill chuck.
Figure 13:
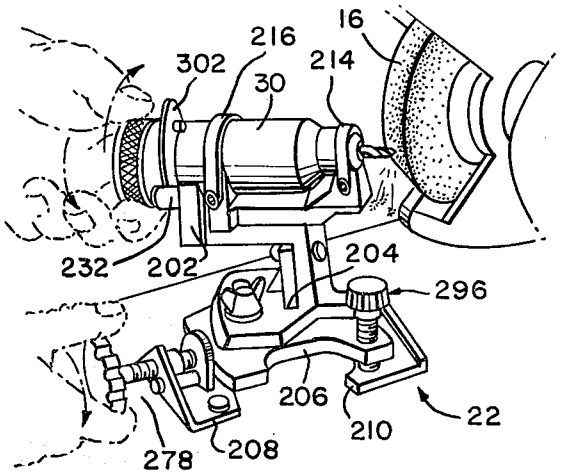
FIG. 13 is a perspective view of the drill sharpening apparatus and chuck in operative relation to a grinding wheel.
Figure 15:
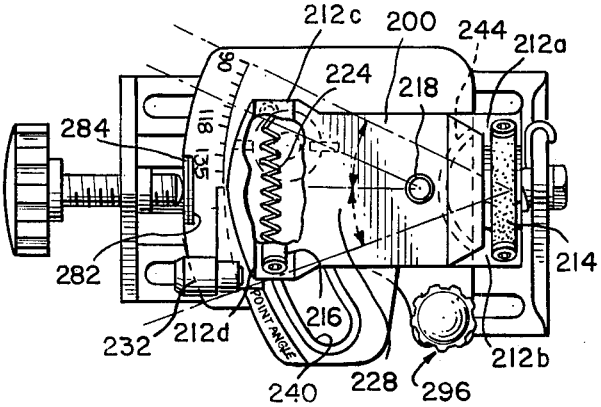
FIG. 15 is a top plan view of the drill sharpening apparatus without the chuck in the chuck holding means thereof.
Figure 17:
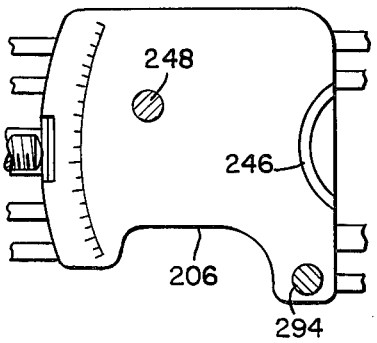
FIG. 17 is a sectional view on line 17—17 of FIG. 16

The drill point angle is then set on the sharpening fixture 22 as illustrated in FIG. 12 of the drawing. The backup feed knob on the sharpening fixture is backed up all of the way. The chuck is then inserted in the sharpening fixture and the chuck is rotated back and forth while lightly holding the wing cam 302 against the cam post 232 FIG. 13 of the drawing. This procedure is illustrated in FIGS. 13 and 14 of the drawing. Simultaneously, the drill is advanced by turning the feed knob 278, FIG. 13 of the drawing until the drill point begins to spark against the grinding wheel. The carriage should then be advanced toward the grinding wheel about ⅛ turn and the chuck is continued to be rotated clockwise until sparking nearly stops and then the feed knob is again advanced and the procedure repeated. The drill should then be sharp and ground to the proper point angle and flute relief.

We claim:

1. A twist drill sharpener comprising a twist drill chuck and a sharpening fixture, (a) said chuck comprising an elongated barrel portion having a cylindrical outer surface, a nose portion received on one end of the barrel portion, said nose portion including a truncated inner conical surface and a cylindrical outer surface, a first sharpening control wing cam secured to the other end of the barrel portion, a plurality of chuck jaw members, a fixture slideable in the chuck barrel portion having chuck jaw receiving slots in one end, external threads on the other end of the said fixture, spring means passing through its respective jaw and having ends engaged in said fixture slideable in the chuck barrel, a jaw control element, said control element having internal threads engaging the external threads on said fixture to cause said fixture to move longitudinally in the chuck barrel when said control element is rotated;

(b) said sharpening fixture comprising front and rear chuck supporting cradles adapted to support the chuck for rotation and limited longitudinal motion, a second sharpening control cam formed at the rear end of the rear cradle, a first support for said chuck supporting cradles, means mounting said chuck supporting cradles to said first support on a vertical axis, a stop member on said first support, spring means urging the cradles against the stop member, a chuck feed plate, means pivotly mounting said first support to said feed plate, front and rear sharpening fixture supports, a support rod mounted between the front and rear sharpening fixture supports, means slideably and rotatably mounting said feed plate to slide and rotate on said support rod, and means for causing said feed plate to slide and rotate on said support rod and wherein the said first sharpening control wing cam supports a pair of cam followers.

2. The twist drill sharpener as defined in claim 1, wherein said spring means contact each of said jaw members in a portion of the body of each jaw member.

3. The twist drill sharpener as defined in claim 1, including a spring mounted about the support rod, continuously urging the chuck feed plate in one direction.

4. The twist drill sharpener as defined in claim 3, including a second spring acting between the front sharpening fixture support and the chuck feed plate urging the feed plate to rotate on said support rod.

5. A twist drill sharpener comprising a twist drill chuck, a relief setting fixture and a sharpening fixture, (a) said chuck comprising an elongated barrel portion having a cylindrical outer surface, a nose portion received on one end of the barrel portion, said nose portion including a truncated inner conical surface and a cylindrical outer surface, a first sharpening control wing cam secured to the other end of the barrel portion, a plurality of chuck jaw members, a fixture slideable in the chuck barrel portion having chuck jaw receiving slots in one end, external threads on the other end of the said fixture, spring means for each of the plurality of chuck jaws, said spring means passing through its respective jaw and having ends engaged in said fixture slideable in the chuck barrel, a jaw control element, said control element having internal threads engaging the external threads on said fixture to cause said fixture to move longitudinally in the chuck barrel when said control element is rotated;

(b) said relief setting fixture comprising front and rear cradles adapted to support the chuck, a pair of offset drill cutting edge engaging members, means mounting said cutting edge engaging members at the front end of the relief setting fixture, control lever means, means mounting said control lever means for arcuate movement, means connecting the control lever means to said cutting edge engaging members for movement of said members toward and away from each other upon movement of the control lever means, and a chuck engaging band mounted to said fixture between said front and rear cradles;

(c) said sharpening fixture comprising front and rear chuck supporting cradles adapted to support the chuck for rotation and limited longitudinal motion, a second sharpening control cam formed at the rear end of the rear cradle, a first support for said chuck supporting cradles, means mounting said chuck supporting cradles to said first support on a vertical axis, a stop member on said first support, spring means urging the cradles against the stop member, a chuck feed plate, means pivotly mounting said first support to said feed plate, front and rear sharpening fixture supports, a support rod mounted between the front and rear sharpening fixture supports, means slideably and rotatably mounting said feed plate to slide and rotate on said support rod, and means for causing said feed plate to slide and rotate on said support rod.

6. The twist drill sharpener as defined in claims 1 or 5, wherein the chuck is provided with 4 equally radially spaced chuck jaw members.

7. The twist drill sharpener as defined in claims 1 or 5, wherein there are six equally radially spaced jaw members.

8. The twist drill sharpener as defined in claim 5, wherein the said first sharpening control wing cam supports a pair of cam followers.

9. The twist drill sharpener as defined in claim 5, including a chuck engaging band supported by said relief setting fixture movable from a chuck engaging to a chuck disengaging position.

10. The twist drill sharpener as defined in claim 5, wherein the inner surface of the barrel portion has affixed thereto a longitudinally extending key and the fixture slideable in the chuck barrel portion has a mating keyway.

11. The twist drill sharpener as defined in claim 9, wherein one end of said chuck engaging band is mounted to the relief setting fixture through a lever operated eccentric.

12. A twist drill sharpener comprising a twist drill chuck and a sharpening fixture, (a) said chuck comprising an elongated barrel portion having a cylindrical outer surface, a nose portion received on one end of the barrel portion, said nose portion including a truncated inner conical surface and a cylindrical outer surface, a first sharpening control wing cam secured to the other end of the barrel portion, a plurality of chuck jaw members, a fixture slideable in the chuck barrel portion having chuck jaw receiving slots in one end, external threads on the other end of said fixture, spring means for each of the plurality of chuck jaws, said spring means passing through its respective jaw and having ends engaged in said fixture slideable in the chuck barrel, a jaw control element, said control element having internal threads engaging the external threads on said fixture to cause said fixture to move longitudinally in the chuck barrel when said control element is rotated;

(b) said sharpening fixture comprising front and rear chuck supporting cradles adapted to support the chuck for rotation and limited longitudinal motion, a second sharpening control cam formed at the rear end of the rear cradle, a first support for said chuck supporting cradles, means mounting said chuck supporting cradles to said first support on a vertical axis, a stop member on said first support, spring means urging the cradles against the stop member, a chuck feed plate, means pivotly mounting said first support to said feed plate, front and rear sharpening fixture supports, a support rod mounted between the front and rear sharpening fixture supports, means slideably and rotatably mounting said feed plate to slide and rotate on said support rod, and means for causing said feed plate to slide and rotate on said support rod, wherein the said second sharpening control cam formed at the rearward end of the rear cradle is cast as an integral part of said rear cradle.

13. The twist drill sharpener as defined in claim 12, including a cross feed screw acting between the rear sharpening fixture support and the rear end of said chuck feed plate.

14. The twist drill sharpener as defined in claim 13, including an adjusting screw carried by the chuck feed plate and having one end bearing against the front sharpening fixture support.

15. A twist drill sharpener comprising a twist drill chuck and a sharpening fixture, (a) said chuck comprising an elongated barrel portion having a cylindrical outer surface, a nose portion received on one end of the barrel portion, said nose portion including a truncated inner conical surface and a cylindrical outer surface, a first sharpening control wing cam secured to the other end of the barrel portion, a plurality of chuck jaw members, a fixture slideable in the chuck barrel portion having chuck jaw receiving slots in one end, external threads on the other end of the said fixture, spring means for each of the plurality of chuck jaws, said spring means passing through its respective jaw and having ends engaged in said fixture slideable in the chuck barrel, a jaw control element, said control element having internal threads engaging the external threads on said fixture to cause said fixture to move longitudinally in the chuck barrel when said control element is rotated;

(b) said sharpening fixture comprising front and rear chuck supporting cradles adapted to support the chuck for rotation and limited longitudinal motion, a second sharpening control cam formed at the rear end of the rear cradle, a first support for said chuck supporting cradles, means mounting said chuck supporting cradles to said first support on a vertical axis, a stop member on said first support, spring means urging the cradles against the stop member, a chuck feed plate, means pivotly mounting said first support to said feed plate, front and rear sharpening fixture supports, a support rod mounted between the front and rear sharpening fixture supports, means slideably and rotatably mounting said feed plate to slide and rotate on said support rod, and means for causing said feed plate to slide and rotate on said support rod, wherein the inner surface of the barrel portion has affixed thereto a longitudinally extending key and the fixture slideable in the chuck barrel portion has a mating keyway.

* * * * *